US006173889B1

(12) United States Patent
Sutherland

(10) Patent No.: US 6,173,889 B1
(45) Date of Patent: Jan. 16, 2001

(54) CARTON PANEL LOCK

(75) Inventor: Robert L. Sutherland, Kennesaw, GA (US)

(73) Assignee: Riverwood International Corporation, Atlanta, GA (US)

( * ) Notice: Under 35 U.S.C. 154(b), the term of this patent shall be extended for 0 days.

(21) Appl. No.: 09/461,878

(22) Filed: Dec. 15, 1999

(51) Int. Cl.[7] ..... B65D 5/42
(52) U.S. Cl. ..... 229/198.2; 229/103.2
(58) Field of Search ..... 229/103.2, 198.2; 206/140, 427

(56) References Cited

U.S. PATENT DOCUMENTS 3,655,117 * 4/1972 Weiss ..... 229/103.2
4,611,754 * 9/1986 Sutherland ..... 229/198.2
4,815,599 * 3/1989 Schuster ..... 206/427
4,844,328 * 7/1989 Cooper ..... 206/427
5,398,870 * 3/1995 Bienaime ..... 229/198.2
5,671,845 * 9/1997 Harris ..... 229/103.2
5,682,995 * 11/1997 Sutherland ..... 206/140
5,975,286 * 11/1999 Oliff ..... 206/140

* cited by examiner

*Primary Examiner*—Gary E. Elkins

(57) ABSTRACT

A mechanical lock assembly for a wrap-around carton. The mechanical lock assembly has a primary variable lock belt, which both prevents withdrawal of a locking tab after it has been inserted into a locking opening of an associated overlapping panel flap, and enables the lock to adjust according to the size carried items. A secondary locking system prevents the primary locking system from disengaging.

19 Claims, 10 Drawing Sheets

CARTON PANEL LOCK

BACKGROUND OF THE INVENTION

1. Field of the Invention

This invention relates generally to mechanical locks for holding overlapping flaps of a wrap-around carton in place. More particularly, it relates to a belt lock that provides a variable lock size.

2. Prior Art

When fabricating a carton from a paperboard blank, opposite ends of the blank are conventionally attached to each other by glue or by a mechanical lock to form the bottom panel of the carton. In the case of a wrap-around carton, flaps located on the ends of the blank typically are overlapped and engaged with one another by mechanical locks formed in the flaps to form the bottom panel of the carton. Since the bottom panel must maintain its integrity throughout the use of the carton, it is essential that the locking system be capable of supporting the weight of the packaged articles, and remain engaged during shipping and handling of the constructed carton.

One approach to provide such a stable mechanical lock assembly utilizes primary and secondary locks. The primary locks connect the ends of the carton together via the flaps, while the secondary locks function to maintain the engaged flaps in place in order to provide a "backup" locking system to prevent the primary locks from separating.

A superior locking system that overcomes many of the deficiencies of prior art locks is disclosed in U.S. Pat. No. 5,443,203 to Sutherland, which describes a mechanical locking system that does not require secondary male locking tabs to extend beyond the end edges of the blank, but which system effectively locks the tabs in place and resists withdrawal of the tabs. Yet, neither this mechanical locking system, nor other prior art systems, incorporate the ability to adjust to the variation in size of the bottles contained by the carton. That is, prior art carton blanks are stamped for a particular sized bottle. Variations in bottle size or out of round bottles necessitate a new carton to accommodate the change.

It would be advantageous to provide a variable mechanical locking system that can adjust for bottle growth or out of round bottles. This type of assembly would allow a single carton to contain a range of different bottle sizes. The present invention and its preferred embodiments provide such variable locking, while they also provide a superior flap engagement assembly.

SUMMARY OF THE INVENTION

Briefly described, in a preferred form, the objects of this invention are achieved by providing both primary and secondary lock systems. The primary lock system allows for container growth or out of round containers in the carton. The primary lock system incorporates two primary locks of different sizes located in the carton's outer bottom panel flap so that at least one of these locks will engage with the female sloped lock ledge of the carton's inner bottom panel flap. Both of these primary locks will be engaged when the containers are of normal size. If the containers are oversized or out of round, then only the larger of the primary locks will be engaged.

The primary locks of this invention are secured in the engaged position by the provision of a secondary lock system that prevents the withdrawal of the primary male locks. A secondary male lock is located in the inner bottom panel flap and connected to the panel by a fold line spaced from the end edge of the flap. An intermediate fold line divides the secondary male lock into an outer portion that extends through a secondary female lock opening in the outer bottom panel flap when the carton is locked. The female lock opening has an edge of a retainer tab that assists in holding the secondary male lock in position. This retainer tab flap prevents the withdrawal of the secondary male lock, which maintains the primary lock system in locked condition.

Primary locking of the carton includes the engagement of at least one primary lock with the novel female sloped lock ledge that forms one end of the primary female lock tab aperture in the inner bottom panel flap. This configuration allows for product growth or out of round products contained in the carton. A carton for containing six (6) containers usually has three (3) sets of two (2) primary male locks, three (3) corresponding primary female lock tab apertures, three (3) secondary male locks and three (3) corresponding secondary female lock openings.

It is an object of the present invention to provide variable carton lock assemblies that are capable of a range of adjustment, yet throughout adjustment, the lock assemblies remain locked. These lock assemblies secure the inner and outer bottom panel flaps of the carton together without the use of glue and the like.

It is a further object of the present invention to provide at least one of the lock assemblies that is self adjusting to allow for container growth or out of round containers, and yet remain in the locked position at all times.

These and other objects, features, and advantages of the present invention will become more apparent upon reading the following specification in conjunction with the accompanying drawing figures.

DETAILED DESCRIPTION OF THE PREFERRED EMBODIMENTS

The present invention is intended primarily for use with wrap-around cartons containing bottles of the types used to contain soft drinks, beer and the like. A typical example of such a bottle has a generally cylindrical body with an upper portion and a bottom, a tapering shoulder smoothly continuous with the upper portion of the body, and a neck formed on the shoulder having a smaller diameter than the body. This conventional bottle B also has a neck flange projecting outwardly from the neck, and a cap attached to the upper end of the neck flange.

Figure 1:
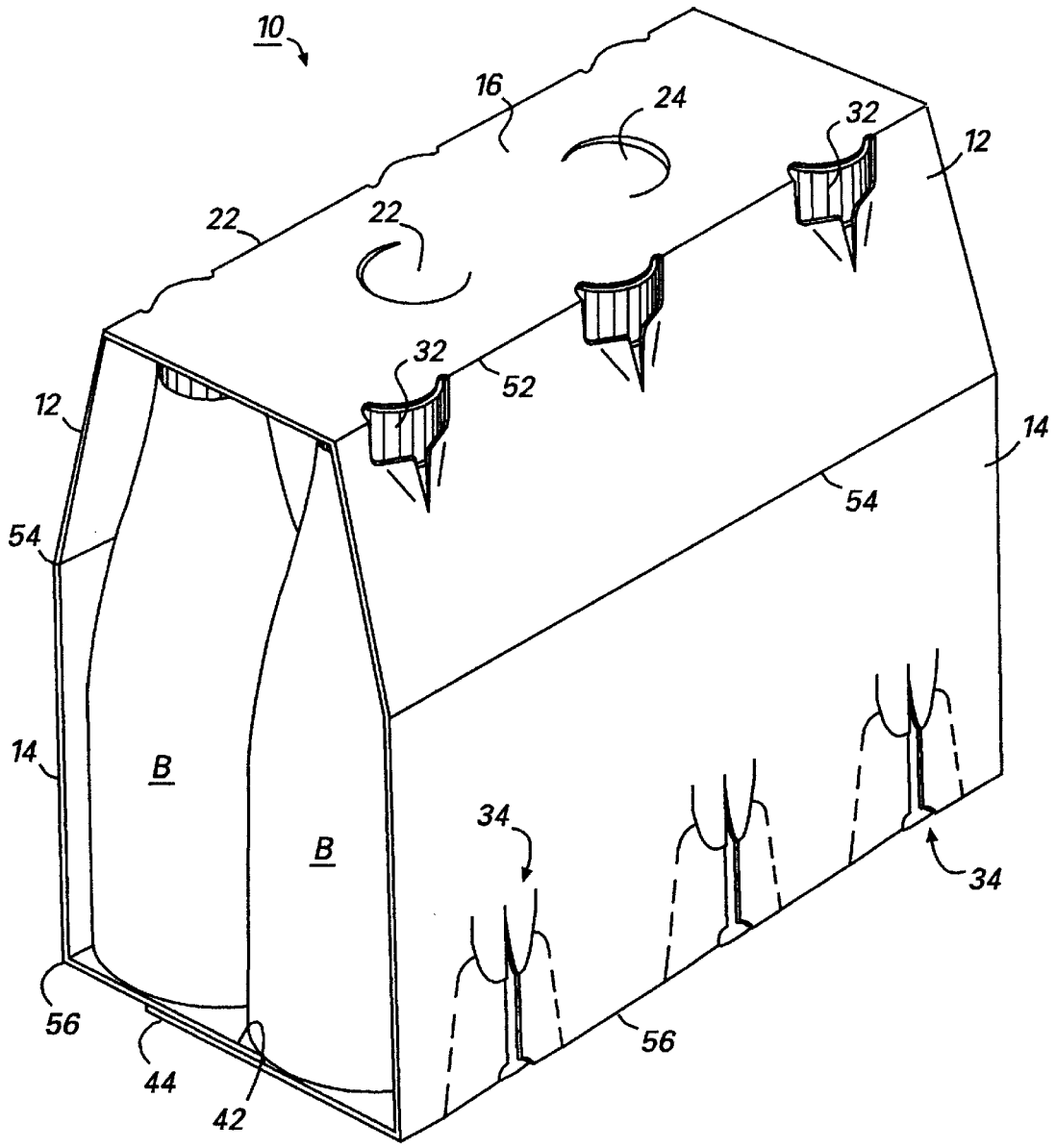
FIG. 1 is a perspective view of a preferred carton in a set up condition and containing bottles, which carton incorporates the variable locking features of the present invention.

A constructed wrap-around carton 10 is illustrated in FIG. 1 containing six beverage bottles B arranged in two rows of three each. The bottles B are packaged in the wrap-around carton 10 that is illustrated in blank form in FIG. 2. The blank is formed from a foldable sheet material, such as paperboard. The carton 10 preferably is comprised of upper side panels 12, lower side panels 14 and top panel 16. Finger gripping apertures 22 and 24, preferably formed by folding finger grip tabs 26 and 28, are formed in the top panel 16 for the purpose of holding the carton 10. Alternatively, finger gripping apertures 22 and 24 may be formed upon original die stamping of the carton 10, wherein tabs 26 and 28 are removed at that time.

The carton 10 further comprises bottle neck openings 32 to permit the extension of a portion of both the neck of the bottle B and the bottle cap outside the body of the carton 10. The carton 10 also includes heel restraining assemblies 34 adjacent the bottom panel, and the bottom panel is comprised of overlapping flaps 42 and 44.

Figure 2:
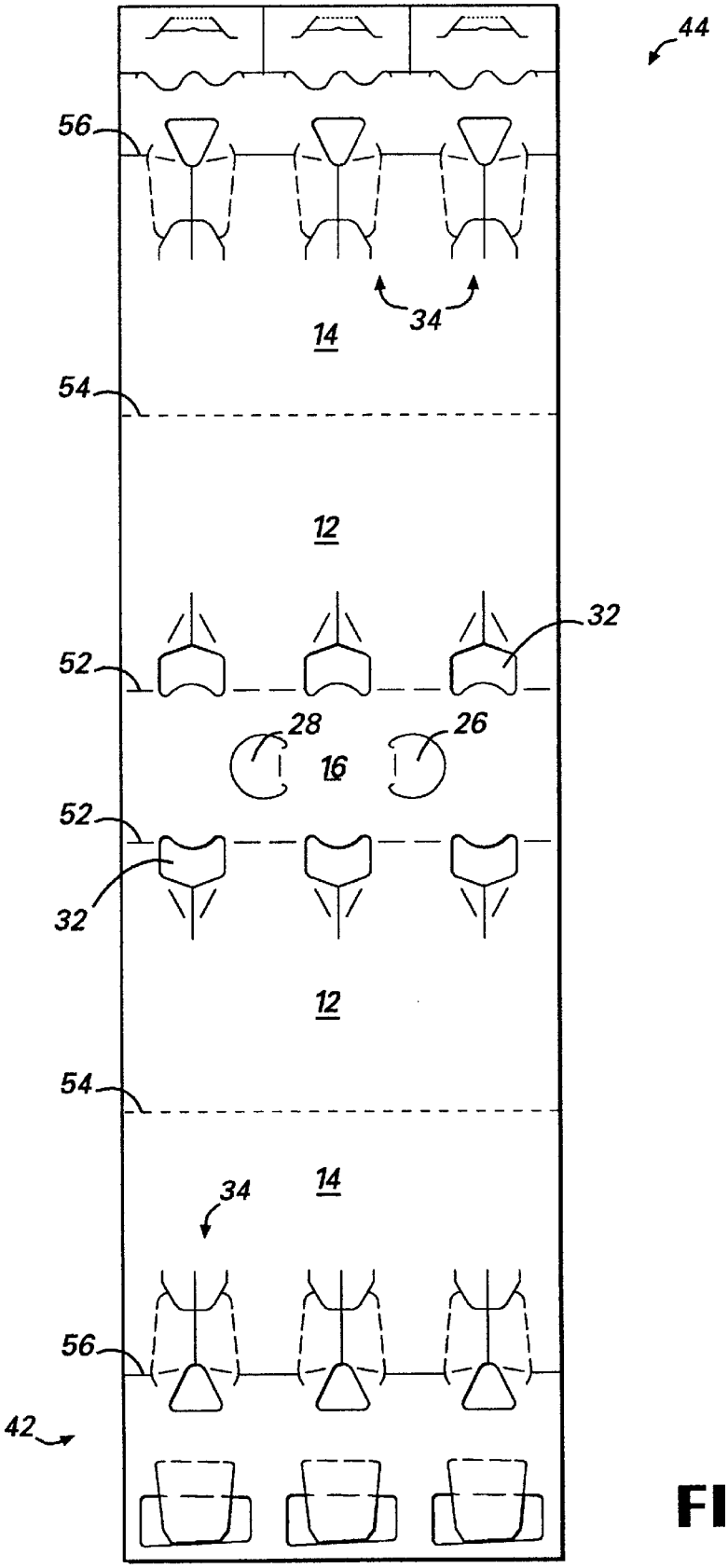
FIG. 2 is a plan view of a blank from which the carton of FIG. 1 is formed.

It will be understood by those in the art that the preferable carton 10 is symmetrical about a horizontal line of bisection, as viewed when FIG. 2 is rotated lengthwise. This symmetry aids in the efficient production of the present carton. The carton need not have such symmetry, although it is preferred. As shown, the blank is rectangular in shape and includes straight edges, which also makes for an efficient layout of the blanks in a web from which the blanks are cut.

Referring now to FIG. 2, the top panel 16 is foldably joined to upper side panels 12 by fold lines 52. Fold lines 52 are interrupted by bottle neck openings 32. Upper side panels 12 are in turn foldably joined to lower side panels 14 by fold lines 54. Flaps 42, 44 are foldably joined to lower side panels 14 by fold lines 56. Fold lines 56 are interrupted by the heel restraining assemblies 34.

Figure 3:
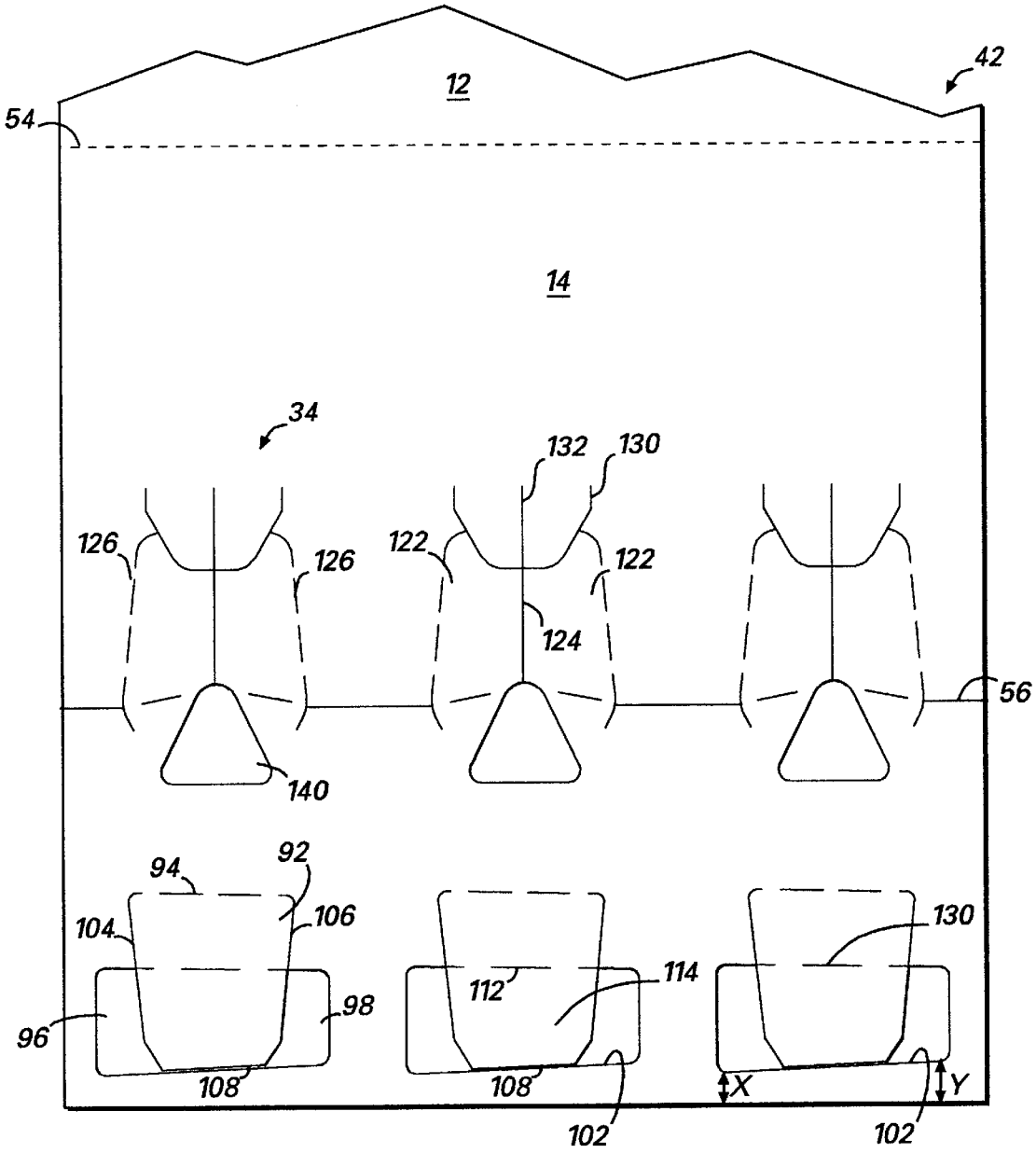
FIG. 3 is a plan view of the side panel and inner bottom panel flap of the blank of FIG. 2.
Figure 4:
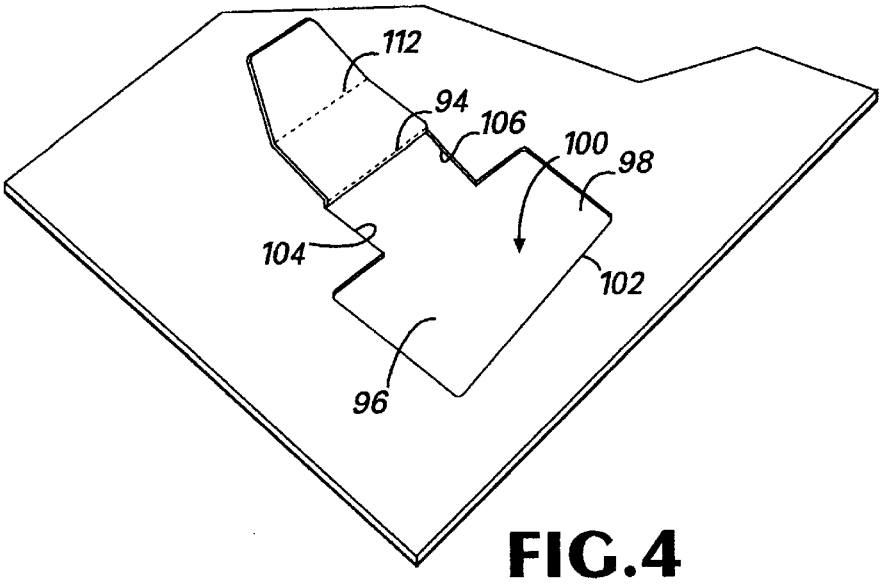
FIG. 4 is a perspective view of a secondary male lock and a primary female lock tab aperture of the present locking assembly according to a preferred embodiment.

Referring specifically to FIGS. 2–4, the inner bottom panel flap 42 includes secondary male locks 92, one located opposite each heel restraining assembly 34, and connected to the inner bottom panel flap 42 by fold line 94. First and second tab cutouts 96, 98 are located to either side of the secondary male locks 92. Upon lifting lock 92 about fold line 94, cutouts 96, 98 merge into an integral primary female lock tab aperture 100, shown in FIG. 4. The outermost end of aperture 100 is formed by an offset lock ledge, or female sloped lock ledge, 102. The slope of offset lock ledge 102 provides the present locking systems with a range of varying locking positions when ledge 102 is in engagement with first or second primary male locks of outer bottom panel flap 44, described below.

As shown in FIG. 3, the main body of each secondary male lock 92 is formed by slits 104, 106 extending outwardly from the ends of the fold line 94, and transverse slit 108. Slit 108 forms the middle portion of offset lock ledge 102. Slits 104, 106, fold line 94 and offset lock ledge 102 bound aperture 100 when tab 92 is lifted, as illustrated in FIG. 4. Secondary male lock 92 is divided into two portions by fold line 112. The lock portion 114 of the secondary male lock 92 extends outwardly of the fold line 112 ends at slit 108 of offset lock ledge 102.

Figure 5:
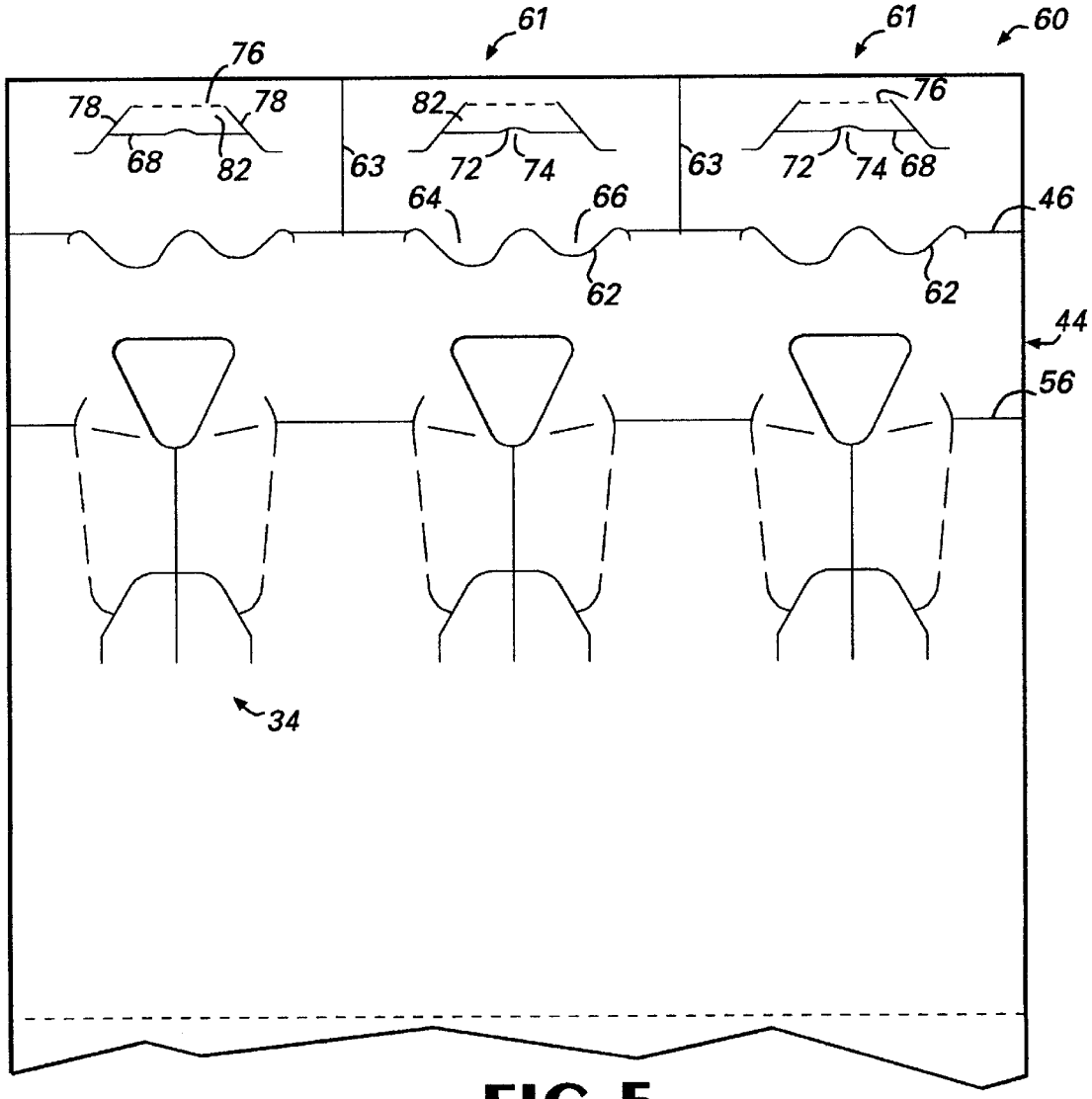
FIG. 5 is a plan view of the side panel and outer bottom panel flap of the blank of FIG. 2.

As shown in FIGS. 2 and 5, the outer bottom panel flap 44 includes a locking panel section 60 connected to the main body of the flap 44 by a fold line 46. Locking panel section 60 can be divided into primary lock panel sections 61 by slits 63. Preferably, the number of primary lock panel sections 61 equals the number of heel restraining assemblies 34, and each primary lock panel section 61 is of an equal size and shape. The slits 63 between the primary lock panel sections 61 permit small adjustments in the carton size. The bottle size may vary between primary lock panel sections 61 which enables each lock panel section to adjust to the size of the bottles immediately above the primary lock panel section 61. Interrupting the fold line 46 opposite each heel restraining assembly 34 are spaced slits 62, each slit 62 forming first and second primary locks 64, 66.

Located in the locking panel section 60 opposite each set of first and second primary locks 64, 66 are slits 68, each of which includes an outwardly extending accurate portion 72 forming a small retainer tab 74. The slits 68 form secondary female lock openings which function in conjunction with the secondary male locks 92 as explained in more detail below. Fold lines 76 are outwardly spaced from the slits 68, and the ends of the fold lines 76 and the slits 68 are connected by transverse slits 78, which extend slightly beyond the slits 68. This arrangement forms retaining flaps 82 adjacent the slits 68.

The locking systems of the present invention as described include both a primary locking system and a secondary locking system. The primary locking system is the locking arrangement between the first and second primary locks 64, 66 of primary lock panel sections 61, and the female sloped lock ledge 102 forming an end of primary female lock tab aperture 100. The secondary locking system is the locking arrangement between the secondary female lock openings (slit 68), and the secondary male locks 92.

Figure 6:
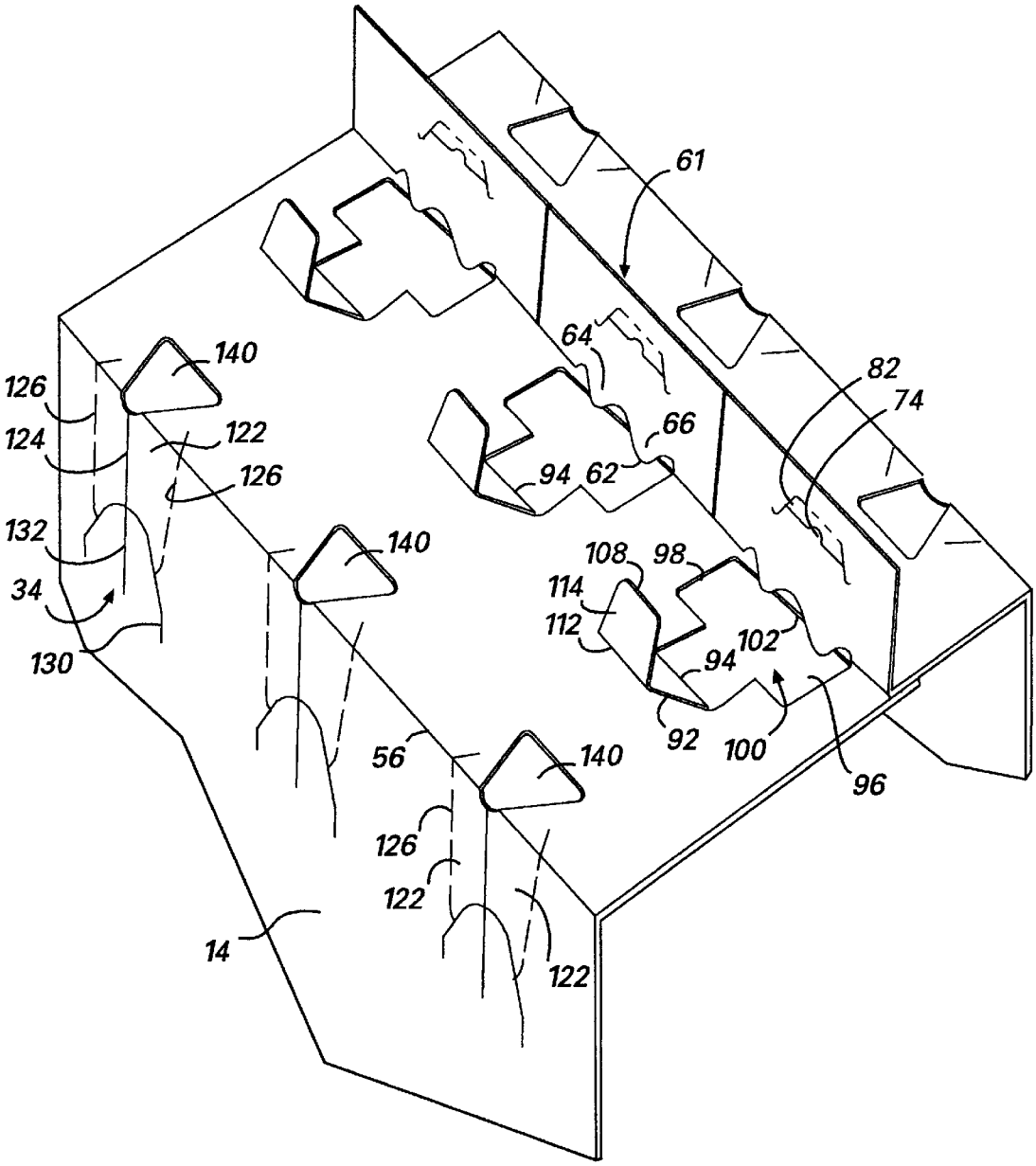
FIG. 6 is a pictorial view of the bottom of a preferred carton, with the bottles removed for the purpose of clarity, demonstrating the first phase of the formation of the bottom panel.
Figure 7:
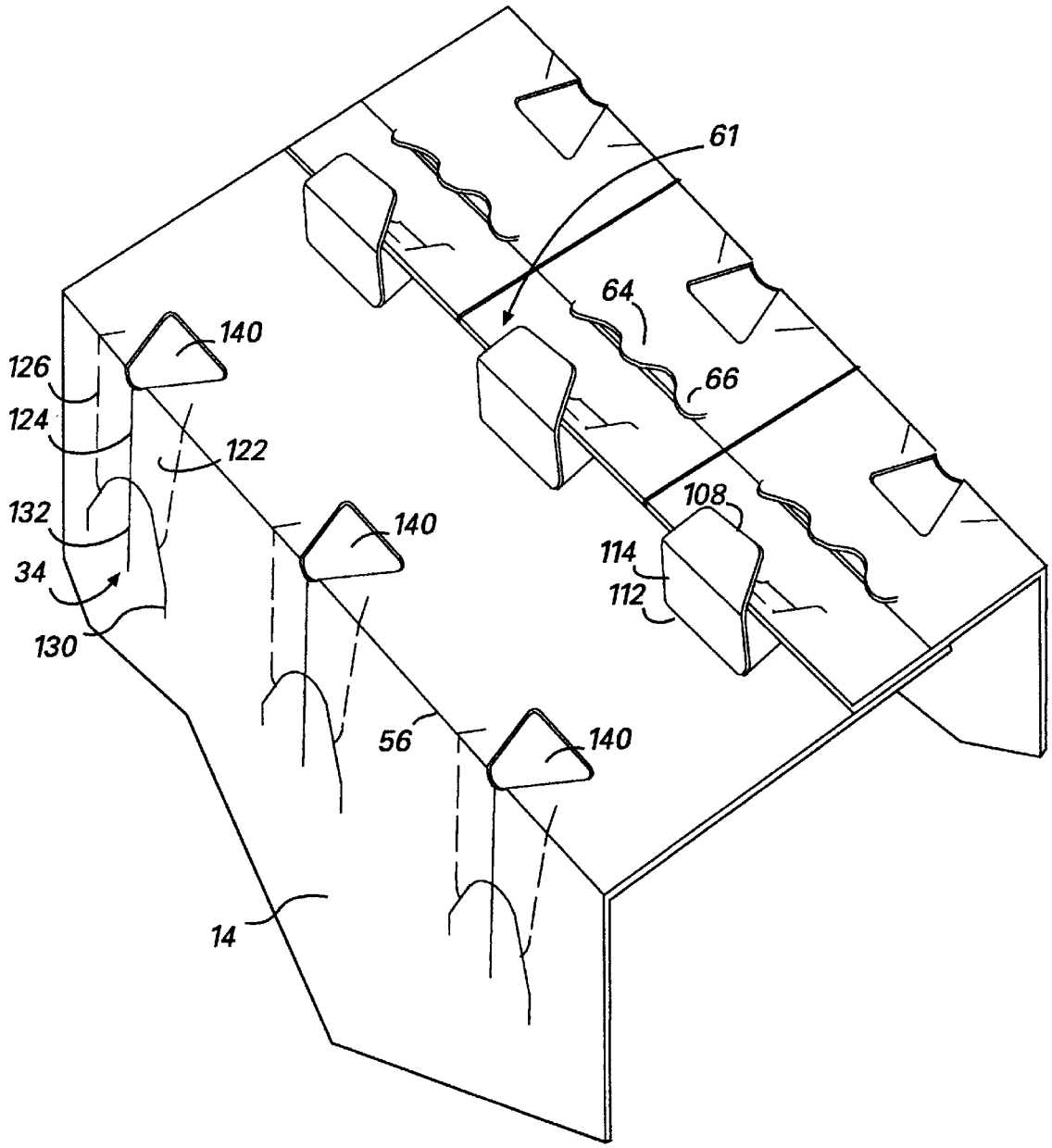
FIG. 7 is a pictorial view similar to that of FIG. 6 but showing the bottom panel flaps at a next intermediate stage of bottom panel formation.

The wrap-around carton 10 of FIG. 1 is formed by moving the top panel 16 of the blank so that a portion of the necks of a group of bottles B extend up through the bottle neck openings 32. The blank is pulled tight about the bottles B and the bottom panel flaps 42, 44 are overlapped. The primary lock panel sections 61 of locking panel section 60 and the secondary male locks 92 of inner bottom panel flap 42 are then folded back as shown in FIG. 6 (which omits the bottles B for the purpose of clarity), after which the primary lock panel sections 61 are folded down into final position as shown in FIG. 7. Either or both first and second primary locks 64, 66 are placed into primary female lock tab aperture 100 in proximity to offset lock ledge 102. As primary lock panel sections 61 are folded down, one or both of the first and second primary locks 64, 66 engage the offset lock ledge 102, and in their final position are located beneath the inner bottom panel flap 42 as viewed in FIGS. 6 and 7.

Figure 8:
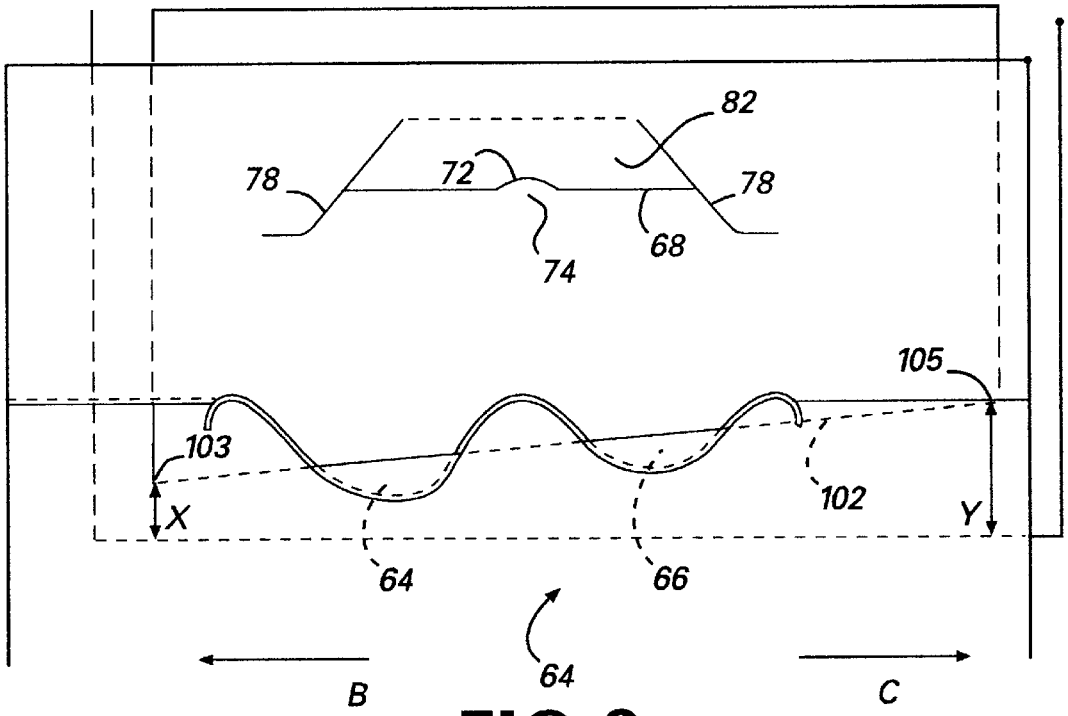
FIG. 8 is a schematic view of the overlapping relationship of the inner and outer bottom panel flaps when two primary locks engage the female sloped lock ledge of the present invention.

FIG. 8 illustrates both first and second primary locks 64, 66 tucked under inner bottom flap 42. This would be possible when, for example, bottles B are neither too large nor out of round. If bottles B necessitate that the bottom panel of the carton 10 be wider to contain bottles B, flaps 42, 44 can move in opposite directions, as referenced by arrows A, thus widening the bottom panel. Yet, the primary locking system of the present invention will remain locked even if lock 66 disengages offset lock ledge 102, as shown in FIG. 9, as lock 64 remains tucked under offset lock ledge 102 because lock 64 extends further than lock 66.

It will be understood by those in the art that while slit 62 is shown in FIG. 5 forming two locking tabs, slit 62 can form more than two locking tabs, each providing another range of locking positions.

Figure 9:
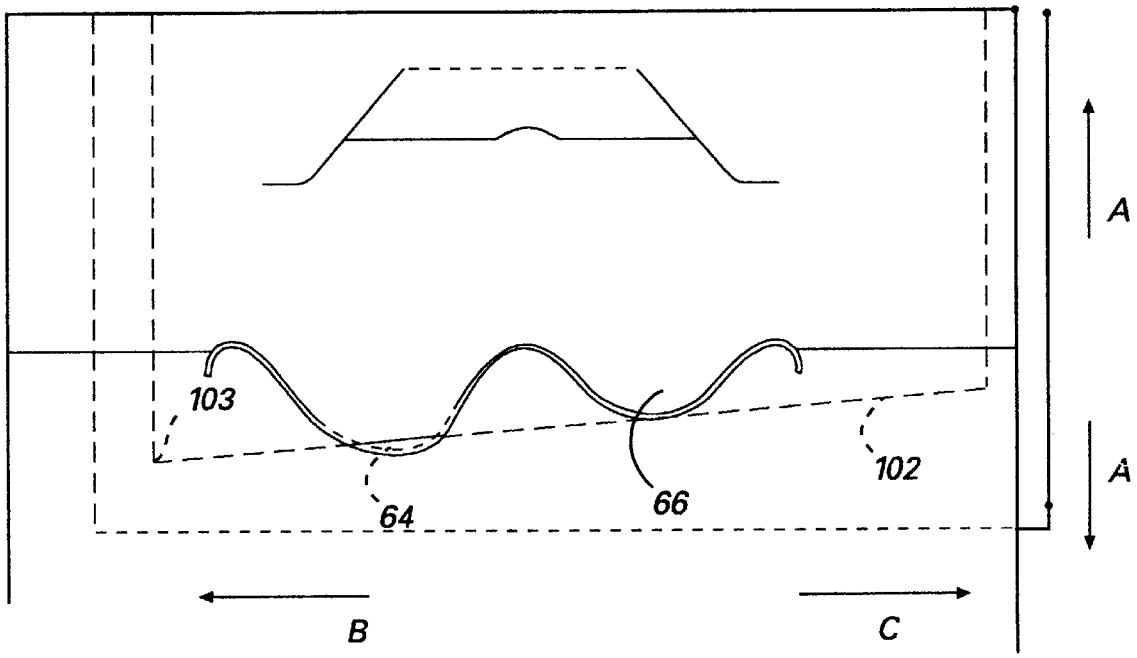
FIG. 9 is a schematic view of the overlapping relationship of the inner and outer bottom panel flaps when only one of two primary locks engages the female sloped lock ledge of the present invention.

FIGS. 8 and 9 also illustrate the novel aspect of providing the carton 10 with a offset lock ledge 102, thus enabling the bottom panel to vary in a range of widths and still remain locked. Further, this variability does not require a new blank design each time the bottle size changes within the range of bottom panel widths provided by the offset lock ledge 102. Additionally, the variability of bottom panel sizes does not interfere with the locking relationship of bottom flaps 42, 44.

Since offset lock ledge 102 is sloped, and since the size of the bottom panel is defined by the engagement between locks 64, 66 and offset lock ledge 102, it is apparent that the size of the bottom panel will vary according to the location of engagement of locks 64, 66 along the length of offset lock ledge 102. FIGS. 3 and 8 illustrate a representative embodiment of offset lock ledge 102 as related to the end of inner bottom panel 42 opposite fold line 56. The distance between offset lock ledge 102 and the end of panel 42 varies between the distances X and Y. Although offset lock ledge 102 is depicted with a constant slope, it will be understood that this need not be the case. Generally, the bottom panel of carton 10 can vary in size by the approximate distance of Y–X. Depending on where one or both of the first and second primary locks 64, 66 engage offset, or sloped, lock ledge 102 along its length, the bottom panel can adjust between a range that is determined mainly by the difference in distances X and Y, being the ends of the offset lock ledge 102.

Further, the carton 10 is self-adjusting, as locking tabs 64, 66 will shift along the length of offset lock ledge 102 in the direction of arrows B or C when the carton 10 with bottles B is raised by top panel 16.

Thus, the present invention can accommodate a range of sizes of bottles B, without the need to modify the blank of the carton 10. The varying lengths of locks 64, 66, as well as the sloping offset lock ledge 102, provide the range of bottom panel sizes.

Figure 10:
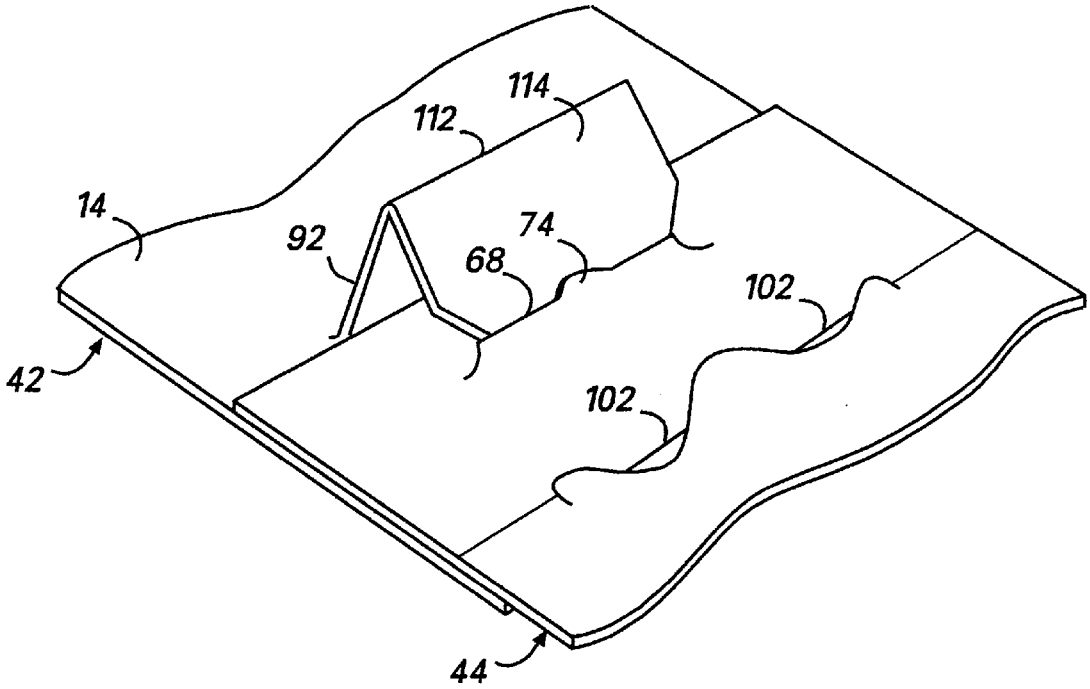
FIG. 10 is a partial pictorial view illustrating a secondary male lock in position to be inserted into a secondary female lock opening.
Figure 11:
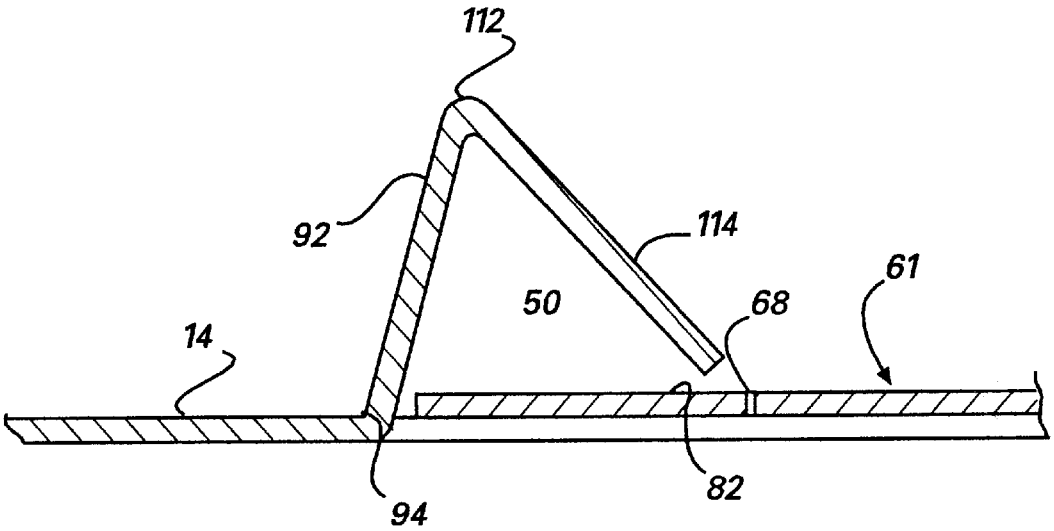
FIG. 11 is an enlarged transverse sectional view of FIG. 10 just prior to secondary male lock insertion into secondary female lock ledge opening.
Figure 12:
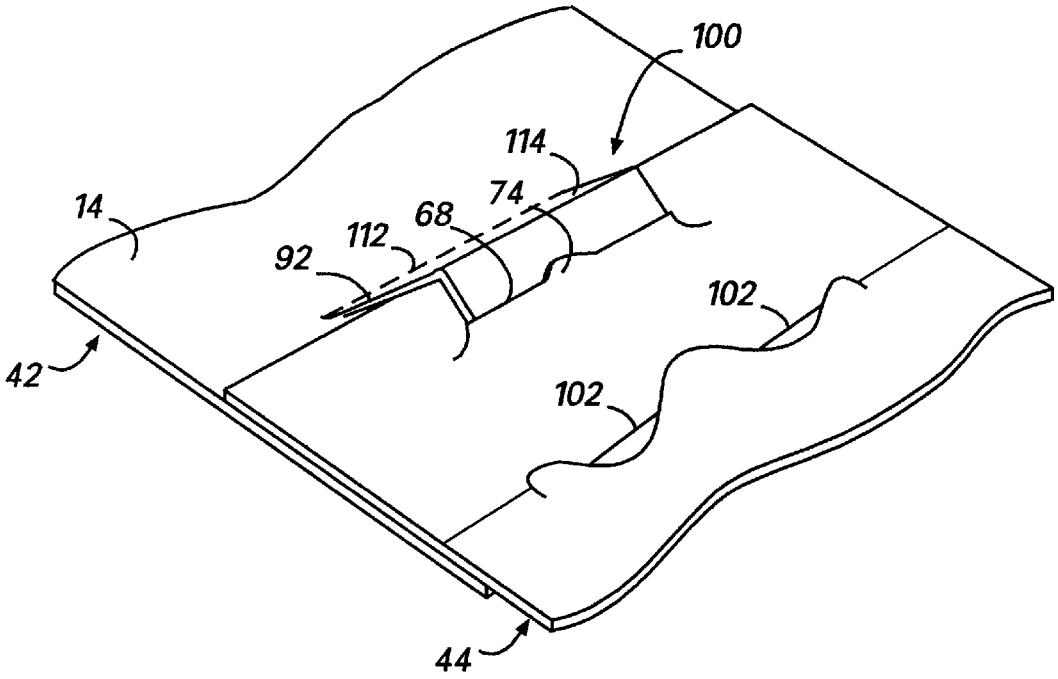
FIG. 12 is a partial pictorial view similar to that of FIG. 10, but illustrating the secondary male lock at a later intermediate position during formation of the bottom panel.
Figure 13:
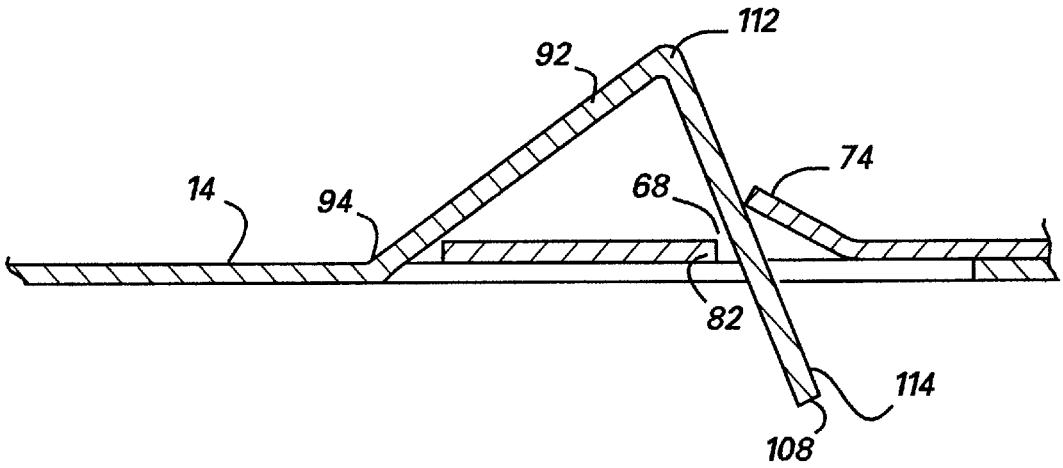
FIG. 13 is an enlarged transverse sectional view of FIG. 12.

The secondary locking system is shown in FIGS. 10–15. As illustrated in FIGS. 10 and 11, the secondary male locks 92 are pivoted forward about the fold lines 94 and their outer portion 114 is folded about the fold line 112 to position the end of the outer portion 114 over the retaining flaps 82 of the secondary female lock openings adjacent the retainer tabs 74. The secondary male locks 92 are then pushed toward the interior of the carton 10, causing the flaps 82 to slightly pivot about their fold lines 76 to permit the angular entry of the outer portions 114 into the space created between the retaining flaps 82 and the edge formed by slits 68. The transverse slits 78 allow adjacent portions of the locking panel section 60 to yield slightly to permit continued downward passage of the outer portion 114 of secondary male locks 92. The relationship of the various locking elements to each other during this intermediate phase of the locking process is illustrated in FIGS. 12 and 13.

Figure 14:
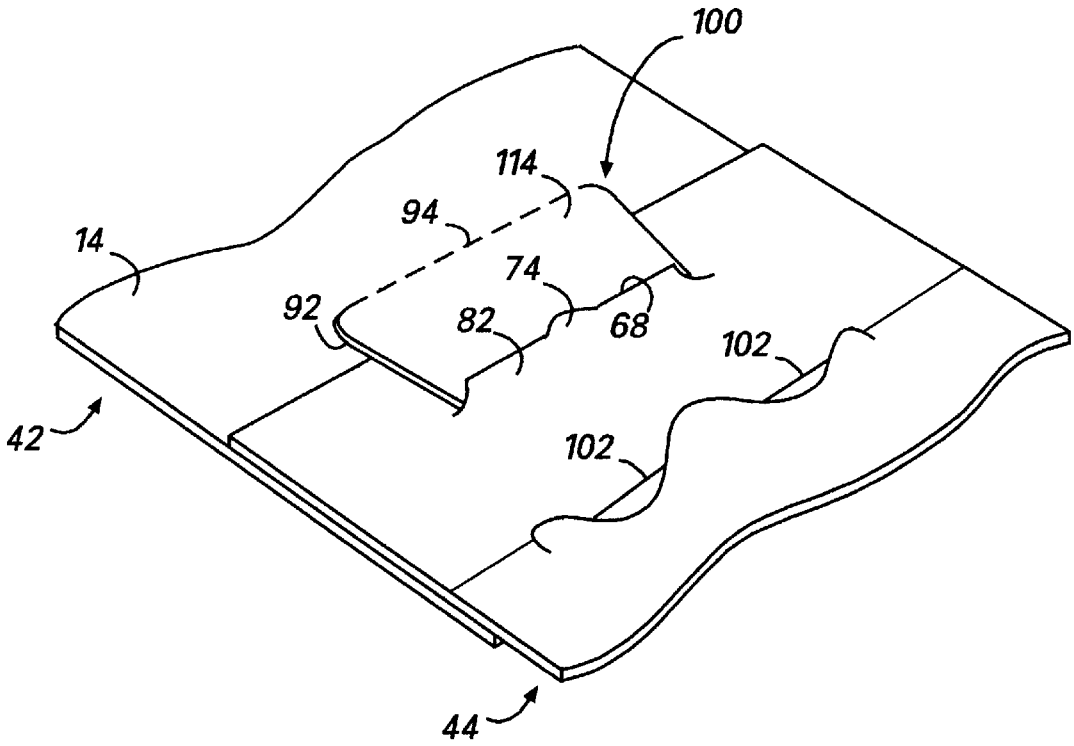
FIG. 14 is a partial pictorial view similar to that of FIG. 10, but illustrating the secondary male lock in its fully inserted position.
Figure 15:
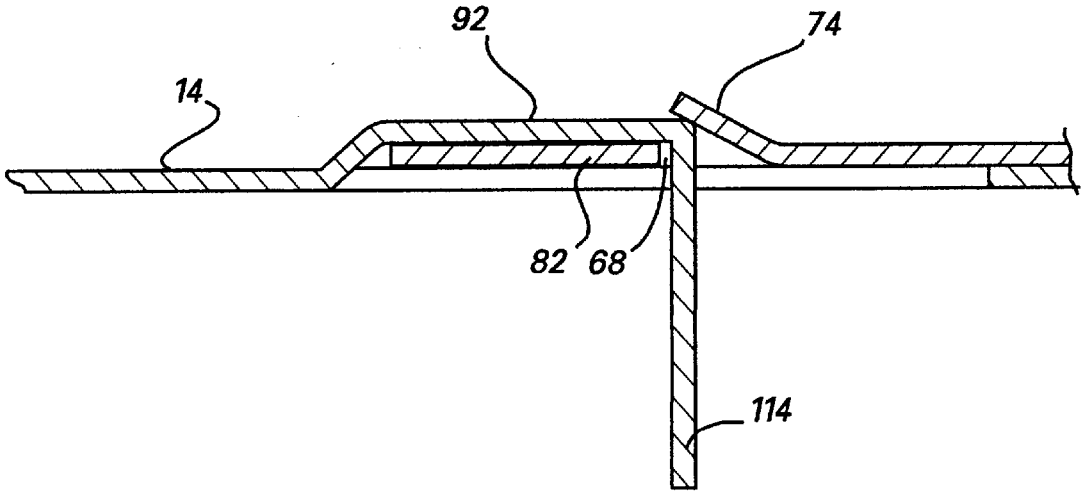
FIG. 15 is an enlarged transverse sectional view of FIG. 14.

Continued movement of the secondary male locks 92 results in the outer portions 114 being fully inserted into the secondary lock openings as shown in FIGS. 14 and 15. During movement of the outer portions 114 of the secondary male locks 92 through the secondary lock openings, the angle between the outer portions 114 and the bottom panel flaps 42, 44 progresses toward a right angle. This can be seen by comparing FIGS. 11, 13 and 15. The contact between the retaining flaps 82 and the outer portions 114 continually biases the outer portions 114 during their movement through the secondary locking openings toward the edges formed by the slits 68. As a result, the outer portions 114 contact and slide past the retaining tabs 74. When relative movement between the secondary locking tab portions 114 and the retainer tabs 74 brings the fold line 112 in proximity to tabs 74, the secondary locking of the locking system of the present invention is established. At the same time, the secondary male locks 92 can slide along the length of slit 68, in step with any sliding of locks 64, 66 along offset lock ledge 102. The fold line 112 can incorporate a knife cut 113, shown in FIG. 3, which would enable tab 74 to insert through cut 113.

It will be understood that flap 42 need not incorporate apertures 100, but only needs offset lock ledge 102 (being a slit cut in panel 42), to lock the primary locking subsystem of the carton 10.

While the locking system of the present invention has been described, below is the preferred embodiment of further elements of the carton 10.

The heels of the contained bottles B are restrained from movement by the provision of heel restraining assemblies 34 of the carton 10, or any other suitable means for restraining the heels of the bottles from falling out of the open ends of the carton 10. It is particularly important to restrain the outside bottles from movement as they in turn will restrain the movement of the inner bottles in the carton 10. A preferred type of heel restraining assembly 34 is illustrated in FIG. 3. Heel doors 122 are provided in the bottom of each lower side panel 14 and extend into the corresponding inner and outer bottom panel flaps 42, 44 through fold lines 56. These doors open inwardly during the erection of the carton 10 from a cut line 124 between each set of heel doors. These doors are hinged to the panels and flaps by fold lines 126. These fold lines 126 permit the heel doors 122 of the carton 10 to be swung inwardly during erection. This permits each bottle B to be nested between a set of adjacent heel doors 122 of each heel restraining assembly 34. This facilitates holding each bottle B in proper position, as illustrated in FIG. 1. More importantly, these doors tend to restrain tearing around the heel apertures that are formed by these doors. Without these doors 122 there would only be cuts that could easily be torn. Further, these doors provide a flexible buffer against which the heel of the bottle can abut without tearing the carton panel surrounding the heel restraining aperture.

Accurate cut lines 130 may be formed at the top of each set of doors to permit the carton to be stretched more tightly over the heels of the bottles. Perpendicular cut lines 132 may also be provided to reduce the stress on the paperboard around the heel of the bottle. The door opening effect allows a relatively large portion of the heel of the bottles to be inserted into the aperture formed by the doors' opening, thereby enabling a relatively strong pack to tighten while minimizing the risk of tearing. As it is important to tighten the carton 10 tightly around the bottles, tightening apertures 140 are provided as extensions into the bottom flaps of the apertures formed by heel doors 122. The tightening apertures 140 allow mechanical tightening fingers to enter and tighten the carton during erection.

While the invention has been disclosed in its preferred forms, it will be apparent to those skilled in the art that many modifications, additions, and deletions can be made therein without departing from the spirit and scope of the invention and its equivalents as set forth in the following claims.

What is claimed is:

1. A wrap-around article carton for carrying articles, comprising:

a. a top panel, opposite side panels and a bottom panel;

b. the bottom panel having inner and outer panel flaps, each panel flap having sides, a portion of the outer panel flap overlapping a portion of the inner panel flap;

c. the inner panel flap having at least one offset lock ledge with a length that slopes towards one side, the lock ledge formed by an opening cut in the inner panel flap;

d. the outer panel flap having at least one primary lock for each offset lock ledge, formed by a slit cut in the outer panel flap, the primary lock having a shorter length than the offset lock ledge; and e. at least one of the primary locks extending through the offset lock ledge along the length of the lock ledge into the carton so as to lock the carton.

2. The carton of claim 1, wherein each offset lock ledge of the inner panel flap forms an end of a primary female lock tab aperture.

3. The carton of claim 1, wherein the outer panel flap comprises at least one set of two primary locks of different sizes, with the combined lengths of the two primary locks being shorter than the length of the offset lock ledge so that at least one of the primary locks of each set secures the carton.

4. The carton of claim 3, wherein the primary locks extend through the offset lock ledge along a distance of the length of the offset lock ledge, and into the carton.

5. The carton of claim 1, wherein each article has a heel, the carton further comprising heel retaining assemblies to retain the heels of the articles.

6. The carton of claim 5, wherein each heel retaining assembly comprises:

a. a set of heel doors attached to the side panels of the carton by fold lines; and b. accurate cut lines formed at the top of the set of heel doors.

7. The carton of claim 5 having three spaced apart offset lock ledges, three spaced apart corresponding primary locks, and three heel retaining assemblies in each respective panel flap.

8. A wrap-around article carton for carrying articles, comprising:

a. a top panel, opposite side panels and a bottom panel;

b. the bottom panel having inner and outer panel flaps, each panel flap having end edges and sides, a portion of the outer panel flap overlapping a portion of the inner panel flap;

c. the inner panel flap having at least one offset lock ledge with a length that slopes towards one side, the offset lock ledge forming an end of a primary female lock tab aperture, the inner panel flap also having at least one secondary male lock connected thereto by a fold line spaced from the end edge of the inner panel flap, the secondary male lock extending a length equal to the distance across the lock tab aperture;

d. the outer panel flap having at least one primary lock for each offset lock edge formed by a slit cut in the outer panel flap, the combined length of the primary locks being shorter than the length for the corresponding lock ledge, the outer panel also having a secondary female lock opening spaced from the end edge of the outer panel flap, one edge of the lock opening being comprised of an edge of a retaining flap connected to the outer panel flap along a fold line located between the secondary female lock opening and the end edge of the outer panel flap;

e. each primary lock extending through the offset lock ledge along the length of the lock ledge, and into the carton as to lock the carton; and f. a portion of each secondary male lock overlapping an end portion of the outer panel flap, and another portion of the secondary male lock extending through the secondary female lock opening in the outer panel flap so as to secure the carton.

9. The carton of claim 8, wherein each secondary male lock includes an intermediate fold line dividing the male lock and delineating a base portion and an outer portion of the secondary male lock, and wherein the base portion of each secondary male lock overlaps an end portion of the outer panel flap, and the outer portion of the secondary male lock extends through the secondary female lock opening in the outer panel flap.

10. The carton of claim 9, wherein the outer panel flap (d) has at least one set of two primary locks of different sizes, with the combined lengths of the two primary locks being shorter than the length of the corresponding offset lock ledge so that at least one of the primary locks of each set secures the carton.

11. The carton of claim 8, wherein there are three (3) sets of primary locks with each set having two (2) primary locks of different sizes and a corresponding set of three (3) primary offset lock ledges, three (3) secondary male locks and three (3) corresponding secondary female lock openings.

12. A panel in an article carton comprising:

a. inner and outer panel flaps, each panel flap having end edges and sides, a portion of the outer panel flap overlapping a portion of the inner panel flap;

b. the inner panel flap having at least one offset lock ledge with a length that slopes towards one side, the offset lock ledge forming an end of a primary female lock tab aperture, the inner panel flap also having at least one secondary male lock connected thereto by a fold line spaced from the end edge of the inner panel flap, the secondary male lock extending a length equal to the distance across the lock tab aperture;

c. the outer panel flap having at least one primary lock for each offset lock edge formed by a slit cut in the outer panel flap, the combined length of the primary locks being shorter than the length for the corresponding lock ledge, the outer panel also having a secondary female lock opening spaced from the end edge of the outer panel flap, one edge of the lock opening being comprised of an edge of a retaining flap connected to the outer panel flap along a fold line located between the secondary female lock opening and the end edge of the outer panel flap;

d. each primary lock extending through the offset lock ledge along the length of the lock ledge, and into the carton as to lock the carton; and e. a portion of each secondary male lock overlapping an end portion of the outer panel flap, and another portion of the secondary male lock extending through the secondary female lock opening in the outer panel flap so as to secure the carton.

13. The panel of claim 12, wherein each secondary male lock includes an intermediate fold line dividing the male lock and delineating a base portion and an outer portion of the secondary male lock, and wherein the base portion of each secondary male lock overlaps an end portion of the outer panel flap, and the outer portion of the secondary male lock extends through the secondary female lock opening in the outer panel flap.

14. The panel of claim 13, wherein the outer panel flap (c) has at least one set of two primary locks of different sizes, with the combined lengths of the two primary locks being shorter than the length of the corresponding offset lock ledge so that at least one of the primary locks of each set secures the carton.

15. The panel of claim 12, wherein there is at least three (3) sets of primary locks with each set having two (2) primary locks of different sizes and a corresponding set of three (3) primary offset lock ledges, three (3) secondary male locks and three (3) corresponding secondary female lock openings.

16. A blank for forming a wrap-around carton, comprising a generally rectangular sheet having ends and sides, said sheet comprising:

a. at one end of the sheet an inner panel flap having at least one offset lock ledge with a length that slopes towards one side of the sheet, the offset lock ledge forming an end of a primary female lock tab aperture, the inner panel flap also having at least one secondary male lock connected thereto by a fold line spaced from the end edge of the inner panel flap, the secondary male lock extending across the lock tab aperture;

b. a side panel, a top panel, and an opposite side panel foldably connected to the inner panel flap in that order; and c. a foldably interconnected outer panel flap on the other end of the sheet having at least one primary lock for each offset lock edge formed by an opening in the outer panel flap, the combined length of the primary locks being shorter than the length for the corresponding lock ledge, the outer panel also having a secondary female lock opening spaced from the end edge of the outer panel flap, one edge of the lock opening being comprised of an edge of a retaining flap connected to the outer panel flap along a fold line located between the secondary female lock opening and the end edge of the outer panel flap.

17. The blank of claim 16, wherein the outer panel flap comprises at least one set of two primary locks of different sizes, with a combined lengths of the two primary locks being shorter than the length of the offset lock ledge.

18. The carton of claim 16, wherein there are three (3) sets of primary locks with each set having two (2) primary locks of different sizes and a corresponding set of three (3) primary offset lock ledges, three (3) secondary male locks and three (3) corresponding secondary female lock openings.

19. The blank of claim 18, wherein the blank has heel retaining assemblies to retain the heel of each article.

* * * * *